US007600504B2

(12) United States Patent
Gangi et al.

(10) Patent No.: US 7,600,504 B2
(45) Date of Patent: Oct. 13, 2009

(54) METHOD FOR OPERATING AN INTERNAL COMBUSTION ENGINE, TAKING INTO CONSIDERATION THE INDIVIDUAL PROPERTIES OF THE INJECTION DEVICES

(75) Inventors: Marco Gangi, Esslingen (DE); Gerit Von Schwertfuehrer, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 83 days.

(21) Appl. No.: 11/660,975

(22) PCT Filed: Jun. 23, 2005

(86) PCT No.: PCT/EP2005/052943

§ 371 (c)(1),
(2), (4) Date: Feb. 28, 2008

(87) PCT Pub. No.: WO2006/021469

PCT Pub. Date: Mar. 2, 2006

(65) Prior Publication Data

US 2008/0262697 A1 Oct. 23, 2008

(30) Foreign Application Priority Data

Aug. 24, 2004 (DE) ..... 10 2004 040 926

(51) Int. Cl.
*G01L 3/00* (2006.01)

(52) U.S. Cl. ..... 123/486; 73/114.15; 73/114.48

(58) Field of Classification Search ..... 123/486, 123/674; 73/114.15, 114.48; 701/104
See application file for complete search history.

(56) References Cited

U.S. PATENT DOCUMENTS

| | | | | |
|---|---|---|---|---|
| 6,085,142 | A | 7/2000 | Di Leo et al. | |
| 6,298,830 | B1 * | 10/2001 | Kono | 123/478 |
| 6,363,314 | B1 | 3/2002 | Hafner et al. | |
| 6,386,180 | B1 * | 5/2002 | Gerhardt et al. | 123/350 |
| RE37,807 | E | 7/2002 | Shinogle et al. | |
| 6,671,611 | B1 | 12/2003 | Peltier | |
| 6,752,126 | B2 * | 6/2004 | Pfaeffle et al. | 123/436 |
| 6,801,847 | B2 * | 10/2004 | Jaliwala et al. | 701/104 |
| 7,162,355 | B2 * | 1/2007 | Yoda et al. | 701/104 |
| 7,164,984 | B2 * | 1/2007 | Radue | 701/115 |

(Continued)

FOREIGN PATENT DOCUMENTS

DE 103 00 194 10/2003

(Continued)

OTHER PUBLICATIONS

Patent Abstracts of Japan, vol. 1999, No. 13, Nov. 30, 1999.

*Primary Examiner*—Erick Solis
(74) *Attorney, Agent, or Firm*—Kenyon & Kenyon LLP

(57) ABSTRACT

A method for operating an internal combustion engine, in which fuel is injected using an injection device into a combustion chamber of a cylinder of the internal combustion engine, a fuel quantity to be injected being ascertained as a function of individual properties of the injection device, and in which functional monitoring is performed, in which an actual torque is ascertained on the basis of performance quantities of the internal combustion engine and monitored for a deviation from a permissible torque. The individual properties of the injection device are taken into consideration when ascertaining the actual torque, where the functional monitoring is improved.

10 Claims, 3 Drawing Sheets

U.S. PATENT DOCUMENTS

| | | | | |
|---|---|---|---|---|
| 7,194,997 | B2 * | 3/2007 | Pitzal et al. | 123/299 |
| 7,346,445 | B2 * | 3/2008 | Von Schwertfuehrer | 701/103 |
| 7,500,465 | B2 * | 3/2009 | Pfaeffle et al. | 123/299 |
| 2004/0099054 | A1 | 5/2004 | Shinogle | |
| 2009/0107227 | A1 * | 4/2009 | Ishizuka et al. | 73/114.74 |

FOREIGN PATENT DOCUMENTS

| | | |
|---|---|---|
| DE | 102 36 820 | 2/2004 |
| EP | 1 396 626 | 3/2004 |
| JP | 8-061052 | 3/1996 |
| JP | 11 229950 | 8/1999 |
| WO | WO 03/085249 | 10/2003 |

* cited by examiner

METHOD FOR OPERATING AN INTERNAL COMBUSTION ENGINE, TAKING INTO CONSIDERATION THE INDIVIDUAL PROPERTIES OF THE INJECTION DEVICES

FIELD OF THE INVENTION

The present invention relates to a method for operating an internal combustion engine, in which fuel is injected using an injection device into a combustion chamber of a cylinder of the internal combustion engine, a fuel quantity to be injected being ascertained as a function of individual properties of the injection device, and in which functional monitoring is performed, during which an actual torque is ascertained on the basis of performance quantities of the internal combustion engine and monitored for deviation from a permissible torque. Furthermore, the present invention relates to a control unit for an internal combustion engine as well as a computer program for a control unit of this type.

BACKGROUND INFORMATION

Within the scope of typical operating methods, the actual torque actually delivered by the internal combustion engine is ascertained from various performance quantities of the internal combustion engine, such as an injection duration and an injection pressure at which the fuel is injected into the combustion chamber. Reliable operation of the internal combustion engine is monitored with the aid of this actual torque. If the actual torque ascertained in the way described above exceeds a predefinable threshold value, for example, an error may be entered in a control unit which controls the internal combustion engine, or the injection device may even be deactivated via a separate shutdown path provided for this purpose. For example, a permissible torque which is derived from a setpoint torque used for activating the internal combustion engine, for example, is also used as the threshold value or comparison value for monitoring the actual torque.

A comparable calculation of the actual torque is discussed, for example, in German patent document DE 103 00 194 A1, which is hereby declared to be part of the disclosure of the present description, and therefore is incorporated by reference in the present application.

However, the typical operating methods are sometimes very inaccurate with regard to ascertaining the actual torque which, inter alia, is to be attributed to a large scatter of the individual properties of the injection devices. In this context, for example, a diameter of a nozzle opening and other characteristic physical variables which are capable of influencing the function of the injection device, as well as aging behavior and the like, for example, are understood as individual properties of the injection device.

This scattering is mostly related to manufacturing and in the present case influences, inter alia, the relationship between the injection duration, the injection pressure, and a fuel quantity actually injected into the combustion chamber, of which the actual torque is in turn a function.

Accordingly, it is the object of the present invention to refine an operating method according to the definition of the species in the main claim as well as a control unit and a computer program for a control unit in such way that more reliable ascertainment of the actual torque and thus improved monitoring of the internal combustion engine are possible.

This object is achieved according to the present invention for an operating method of the type cited at the beginning in that the individual properties of the injection device are taken into consideration when ascertaining the actual torque.

SUMMARY OF THE INVENTION

More precise ascertainment of the actual torque is thus possible, and smaller tolerance thresholds may be established for monitoring of the internal combustion engine using the actual torque, e.g., within the scope of a comparison of the actual torque with a permissible torque derived from the setpoint torque provided for the activation of the internal combustion engine, by which the monitoring is also improved because errors may be recognized more rapidly.

According to a very advantageous embodiment of the present invention, compensating values corresponding to the individual properties of the injection device are used when ascertaining the actual torque. For a specific injection device, for example, such compensating values indicate a deviation of a diameter of a nozzle opening from a value averaged statistically over multiple injection devices for the diameter of the nozzle opening and, in this way, with simultaneous knowledge of the statistically averaged value and the compensating value, allow the nozzle diameter of the injection device in question to be determined and thus to at least partially compensate for its tolerances, which are mostly related to manufacturing.

Of course, depending on the type of the injection device, the compensating values may, for example, also include other physical variables such as a temperature dependence, etc., for example, which vary from device to device, e.g., because of manufacturing-related tolerances or the like.

The compensating values may be ascertained directly during manufacturing, e.g., within the scope of quality control, for example, and assigned to the particular devices, or may also be determined later.

According to a further variation of the present invention, it is particularly advantageous to store the compensating values in a memory (which may be nonvolatile) of a control unit of the internal combustion engine. In this way, the compensating values may be written once into the memory and read out therefrom over the entire service life of the internal combustion engine as needed or modified in the meantime, during maintenance, for example.

In a further very advantageous embodiment of the present invention, the same compensating values are used when ascertaining the actual torque as when ascertaining the fuel quantity to be injected, which is performed within the scope of an activation of the internal combustion engine, for example.

Another advantageous embodiment of the operating method according to the present invention is characterized in that the compensating values are transferred from functions which may be implemented outside the functional monitoring, in particular from an activation of the internal combustion engine. In this way, the compensating values do not have to be read out from an EEPROM or ascertained in another way in the functional monitoring, but rather may be copied directly from corresponding variables of functions responsible for the activation of the internal combustion engine, for example, by which resources of the control unit such as RAM, ROM, and runtime may be saved.

A further refinement of the method according to the present invention is characterized in that the transferred compensating values are subjected to a plausibility check, which may use theoretical maximum values and/or an injection pressure and/or an injected fuel volume. Increased reliability when ascertaining the actual torque is thus provided, which allows even more reliable functional monitoring of the internal combustion engine.

The object of the present invention is further achieved with the help of a control unit for an internal combustion engine according to Claim 7 and a computer program for the control unit according to Claim 9.

In this case, the implementation of the method according to the present invention in the form of the computer program, which has program code capable of performing the method according to the present invention when it is executed on a computer, is of particular significance. Furthermore, the program code may be stored on a computer-readable data carrier, for example, on a flash memory. In these cases, the present invention is thus implemented by the computer program, so that this computer program represents the present invention in the same way as the method which the computer program is capable of executing.

Further features, possible applications, and advantages of the present invention result from the following description of exemplary embodiments of the present invention, which are illustrated in the figures of the drawing.

BRIEF DESCRIPTION OF THE DRAWINGS

FIG. 3 shows the torque curve from FIG. 2 having a threshold a.

DETAILED DESCRIPTION

Figure 1:
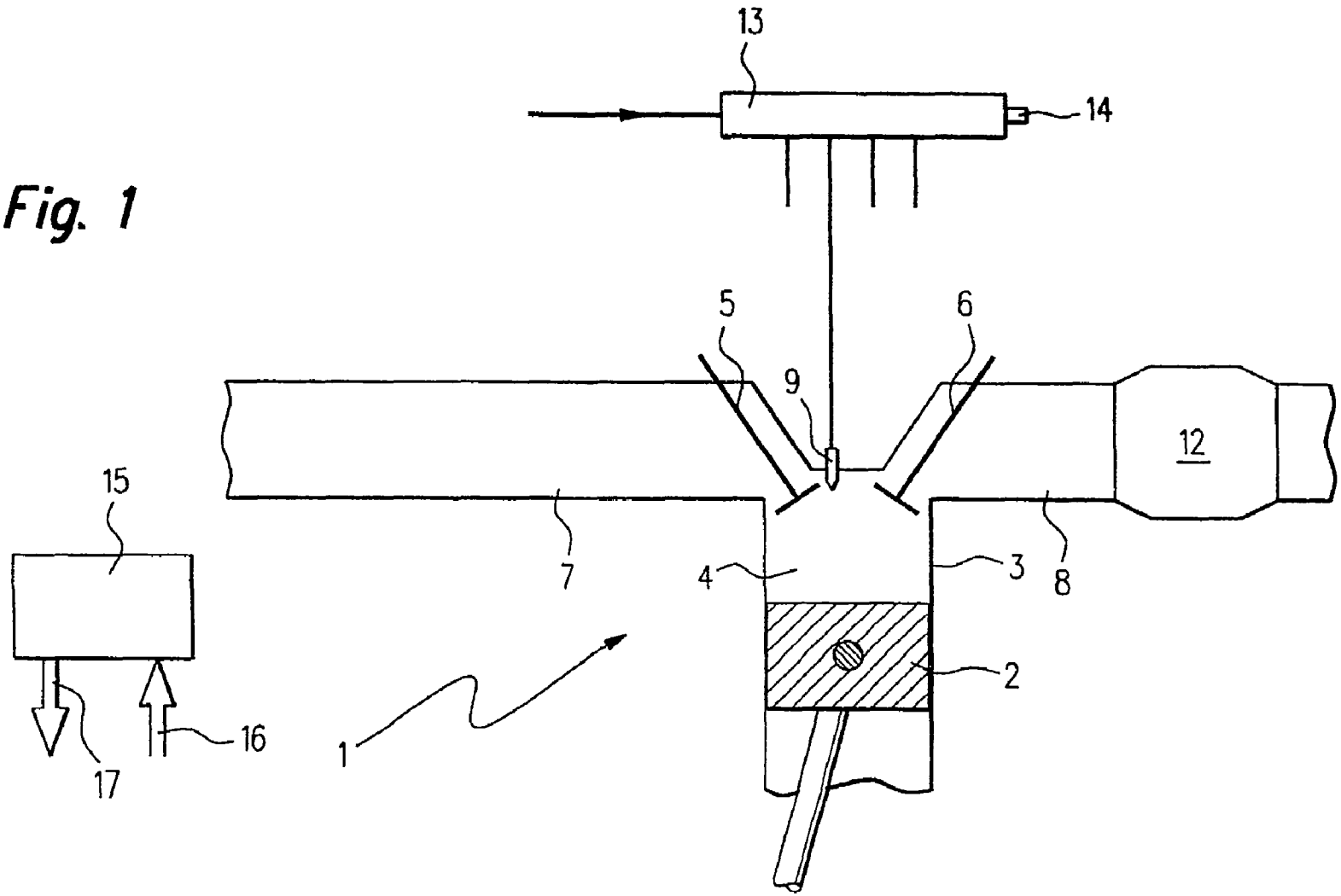
FIG. 1 shows a schematic block diagram of an exemplary embodiment of an internal combustion engine according to the present invention.

An internal combustion engine 1 of a motor vehicle, in which a piston 2 is movable back and forth in a cylinder 3, is illustrated in FIG. 1. Cylinder 3 is provided with a combustion chamber 4 which is delimited, inter alia, by piston 2, an inlet valve 5, and an outlet valve 6. An intake pipe 7 is coupled to inlet valve 5 and an exhaust pipe 8 is coupled to outlet valve 6.

A fuel injector 9 projects into combustion chamber 4 in the area of inlet valve 5 and outlet valve 6, via which fuel may be injected into combustion chamber 4. A catalytic converter 12, which is used for purifying the exhaust gases resulting due to the combustion of the fuel, is housed in exhaust pipe 8.

Fuel injector 9 is connected to a fuel accumulator 13 via a pressure line. In a similar way, the fuel injectors of the other cylinders of internal combustion engine 1 are also connected to fuel accumulator 13. Fuel accumulator 13 is supplied with fuel via a supply line. A mechanical fuel pump may be provided for this purpose, which is capable of building up the desired pressure in fuel accumulator 13.

Furthermore, a pressure sensor 14 is situated on fuel accumulator 13, using which the pressure in fuel accumulator 13 is measurable. This pressure is the pressure which is exerted on the fuel, and at which the fuel is therefore injected via fuel injector 9 into combustion chamber 3 of internal combustion engine 1.

Fuel is delivered into fuel accumulator 13 during the operation of internal combustion engine 1. This fuel is injected via fuel injectors 9 of individual cylinders 3 into associated combustion chambers 4. Pistons 2 are set into a back-and-forth movement by combustion of the air/fuel mixture existing in combustion chambers 3. These movements are transmitted to a crankshaft (not shown) and exert a torque thereon.

A control unit 15 receives input signals 16, which represent performance quantities of internal combustion engine 1 measured using sensors. For example, control unit 15 is connected to pressure sensor 14, an air mass sensor, a speed sensor, and the like. Furthermore, control unit 15 is connected to an accelerator pedal sensor, which produces a signal that indicates the position of an accelerator pedal actuatable by the driver and thus the requested torque. Control unit 15 produces output signals 17, using which the behavior of internal combustion engine 1 may be influenced via actuators or final control elements. For example, control unit 15 is connected to fuel injector 9 and the like and produces the signals required for their activation.

Inter alia, control unit 15 is provided for the purpose of controlling and/or regulating the performance quantities of internal combustion engine 1. For example, the fuel mass injected by fuel injector 9 into combustion chamber 4 is controlled and/or regulated by control unit 15 in particular for low fuel consumption and/or low pollutant emissions. For this purpose, control unit 15 is provided with a microprocessor, which has a computer program stored in a storage medium, in particular in a flash memory, which is capable of performing the cited control and/or regulation.

Functional monitoring of internal combustion engine 1, which is based on ascertaining the torque delivered by internal combustion engine 1, which is referred to in the following as the actual torque, is also implemented in control unit 15.

The actual torque is ascertained computationally by the computer in control unit 15 from performance quantities of internal combustion engine 1 detected by control unit 15. Such performance quantities are, for example, an injection duration, i.e., the length of a time interval over which the fuel is injected into combustion chamber 4, and an injection pressure, i.e., the pressure in fuel accumulator 13, ascertained with the aid of pressure sensor 14, at which the fuel is injected into combustion chamber 4.

Figure 2:
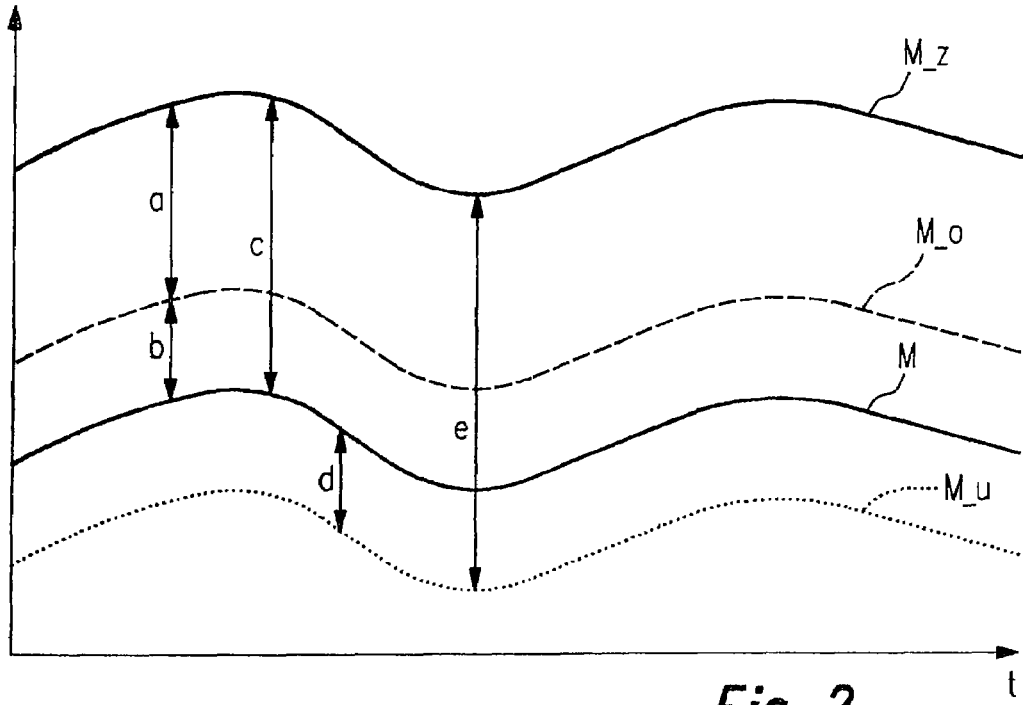
FIG. 2 shows a time curve of the actual torque of the internal combustion engine.

As an example, the time curve of actual torque M is shown in FIG. 2.

To monitor the internal combustion engine, actual torque M may be periodically compared to a permissible torque M_z, which is calculated in control unit 15 on the basis of a setpoint torque, which in turn represents an output value for the activation of internal combustion engine 1. For example, the injection pressure and the injection duration are regulated as a function of this setpoint torque.

The setpoint torque is in turn a function of various variables also a torque command of a driver, who signals the torque requested by him to control unit 15 using the accelerator pedal already noted, for example.

The permissible torque results, for example, from the setpoint torque and a threshold value added to the setpoint torque.

The functional monitoring of internal combustion engine 1 using actual torque M is performed for the purpose in particular of preventing an impermissible increase in actual torque M, as may occur in case of error. If a deviation is established during the above-mentioned comparison between the permissible torque and actual torque M, internal combustion engine 1 may accordingly be deactivated for safety reasons, for example, or at least an error is entered in an error memory of control unit 15.

Because of the manufacturing-related tolerances in fuel injector 9, in typical operating methods a significant deviation may occur between the setpoint torque and actual torque M even without a malfunction in the control of internal combustion engine 1. This deviation occurs because, in the typical method for an activation of fuel injector 9, compensating values are used within the scope of a function also referred to as the injector quantity compensation which compensates for varying individual properties of fuel injector 9, for example, but not for ascertaining the actual torque.

Figure 3:
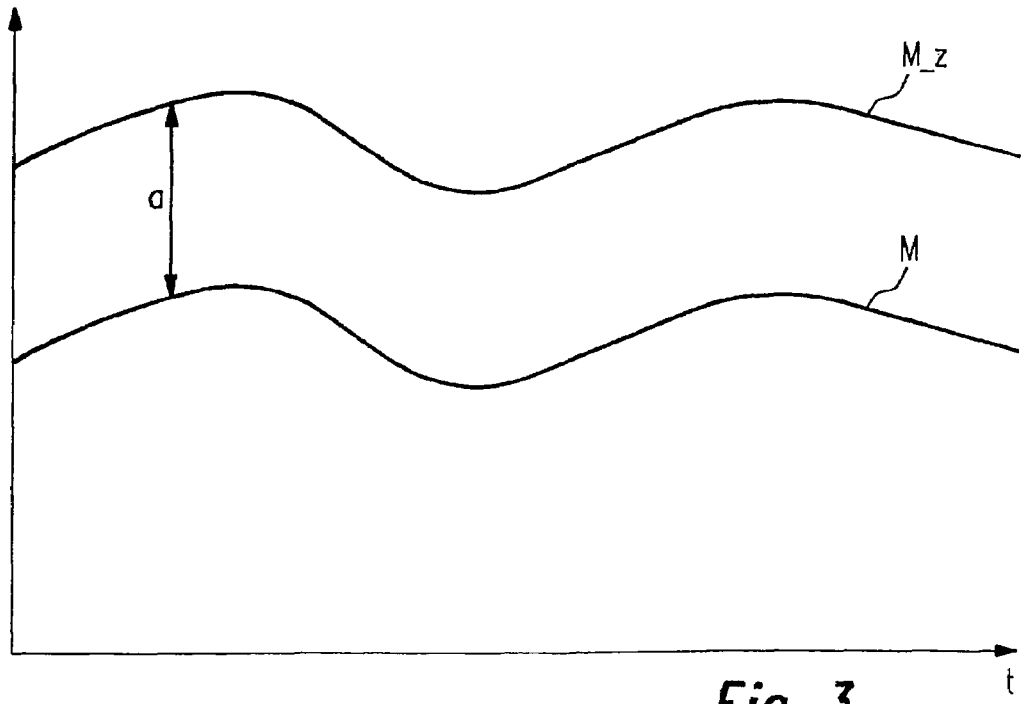

This state of affairs will be explained with reference to FIG. 2 and FIG. 3 in the following, it always being assumed that there is no error. Depending on the intensity of the injector quantity compensation, the ascertained actual torque may be between a lower torque M_u and an upper torque M_o, which define a torque band, which is d+b wide (FIG. 2), around actual torque M, which is identical to the setpoint torque in the ideal case.

In order that deviations from this ideal case caused by the above-mentioned tolerances do not already trigger an error response, for example, the permissible torque must be selected in such a way that an actual torque within interval b+d does not yet result in an error entry. This means that the threshold value for error recognition between the setpoint torque and the permissible torque must—in the direction of increasing torques—be at least b. For safety reasons, a deviation of the actual torque in the direction of higher torques is primarily to be monitored.

Components of the functional monitoring which do not relate to the injector quantity compensation in turn provide inaccuracies in the actual torque calculation, which are taken into consideration by calibratable threshold a, so that torque values within interval a are still viewed as allowed. This is shown in simplified form in FIG. 3. In the diagram in FIG. 3, there is no injector quantity compensation, but rather only threshold a is added to actual torque M to consider all inaccuracies when monitoring actual torque M. An error is not recognized until ascertained actual torque M exceeds this threshold a and the permissible torque thus defined.

For the simultaneous consideration of the injector quantity compensation and the further inaccuracies (FIG. 3), a threshold c=a+b thus results in FIG. 2, starting from an actual torque M which coincides with the setpoint torque in the ideal case. An error is not recognized until the ascertained actual torque exceeds this threshold c and thus permissible torque M_z.

Figure 4:
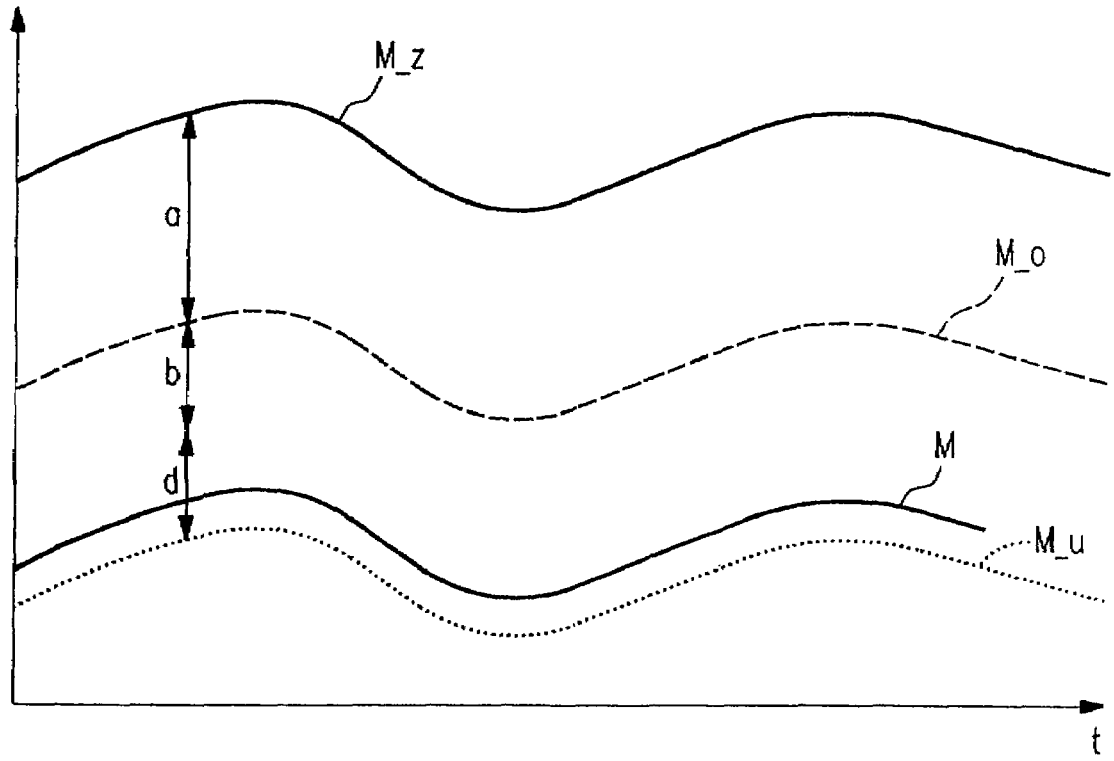
FIG. 4 shows the torque curve from FIG. 2 with the assumption of an error.

In an unfavorable scenario according to FIG. 4, in the typical operating method, ascertained actual torque M is located, for example, in the area of lowest permissible torque M_u. This may be the case because the injector quantity compensation is not taken into consideration when ascertaining actual torque M, although the torque actually delivered by internal combustion engine 1 is in the range of torque M_o, for example.

In order to also be able to effectively recognize an error in the event it occurs, ascertained actual torque M must first exceed permissible torque M_z in this case, i.e., an error would not be recognized until the actual torque was larger than lowest permissible torque M_u by an amount of approximately a+b+d, although the actual torque delivered by internal combustion engine 1 is already significantly greater than M_z because of the error.

In the operating method according to the present invention, compensating values are also taken into consideration for ascertaining actual torque M, analogously to the injector quantity compensation. This means that the individual properties of fuel injector 9 may also be taken into consideration when ascertaining the actual torque within the scope of the functional monitoring of internal combustion engine 1, and the actual torque may thus be calculated more precisely. In this way, thresholds b, d (FIG. 2) may be avoided or significantly reduced, because the fuzziness described above when ascertaining actual torque M, which has resulted in torque band b+d in the typical methods, no longer occurs. This means that only threshold a from FIG. 3, for example, must still be provided as the single threshold for error recognition. Permissible torque M_z only still differs by threshold a from the setpoint torque in the method according to the exemplary embodiment and/or exemplary method of the present invention.

In an exemplary embodiment of the present invention, the compensating values for the injector quantity compensation are stored for each fuel injector 9 of internal combustion engine 1 in an EEPROM memory of control unit 15. From there, for example, they may be input when the internal combustion engine is started and used for the subsequent ascertainment of the actual torque.

Particularly advantageously, the same compensating values are used for ascertaining the actual torque as for the injector quantity compensation during an activation of fuel injectors 9, during which a fuel quantity to be injected may be calculated as a function of the compensating values.

In a further variation of the exemplary embodiment and/or exemplary method of the present invention, the compensating values stored in the EEPROM do not necessarily have to be prepared for being taken into consideration within the scope of the functional monitoring, i.e., when ascertaining the actual torque, because a preparation of this type, for example, is already necessary for the activation of the internal combustion engine and may be transferred therefrom.

It is also possible only to use some compensating values or simplified compensating values derived therefrom instead of all compensating values for ascertaining the actual torque. For example, in the event of compensating values stored individually for each cylinder, it may be sufficient to analyze those compensating values which correspond in the observed internal combustion engine to the fuel injectors having the maximum deviations of their individual properties.

In other words, for example, only the compensating value of the fuel injector deviating maximally from the statistical mean is observed and also used for the other fuel injectors for ascertaining the actual torque. Reliable estimation of the actual torque is thus possible, which still allows a smaller threshold b (FIG. 2), for example, measured on a theoretically maximum deviation of the fuel injector, as is used in conventional methods.

Averaging over the compensating values of the individual fuel injectors is also conceivable.

In another embodiment, in which the compensating values stored in the EEPROM may not be used within the scope of the functional monitoring to ascertain actual torque, the compensating values or values derived therefrom may be transferred from the activation of the fuel and combustion engine, which is also implemented in control unit 15.

In this case, a plausibility check of the values drawn is especially advantageous, which may be performed using the maximum compensating values theoretically possible.

The plausibility check may also be made a function of the injection pressure and/or of the volume of the injected fuel.

The application of the exemplary method according to the present invention may also be used in types of operation in which the injection quantity is not injected into the combustion chamber all at once, but rather distributed over multiple partial injections. The exemplary method according to the present invention may be usable everywhere functional monitoring of the internal combustion engine is performed and variables, in whose ascertainment and/or calculation compensating values are used, are to be monitored.

What is claimed is:

1. A method for operating an internal combustion engine, comprising:

injecting fuel using an injection device into a combustion chamber of a cylinder of the internal combustion engine;

determining a fuel quantity, which is to be injected, as a function of individual properties of the injection device, in which functional monitoring is performed;

determining, during the functional monitoring, an actual torque based on performance quantities of the internal combustion engine; and monitoring for a deviation from a permissible torque, wherein the individual properties of the injection device are considered when determining the actual torque.

2. The method of claim 1, wherein compensating values corresponding to the individual properties of the injection device are used when determining the actual torque.

3. The method of claim 2, wherein the compensating values are stored in a nonvolatile memory of a control unit of the internal combustion engine.

4. The method of claim 2, wherein the same compensating values are used when determining the actual torque as when determining the fuel quantity to be injected.

5. The method of claim 2, wherein the compensating values are transferred from functions implemented outside the functional monitoring, from an activation of the internal combustion engine.

6. The method of claim 5, wherein the transferred compensating values are subjected to a plausibility check, using at least one of theoretical maximum values, an injection pressure and an injected fuel volume.

7. A control unit for operating an internal combustion engine, in which the fuel may be injected using an injection device into a combustion chamber of a cylinder of the internal combustion engine, comprising:

an injection device to inject fuel into a combustion chamber of a cylinder of the internal combustion engine;

a fuel quantity determining arrangement to determine a fuel quantity, which is to be injected, as a function of individual properties of the injection device, in which functional monitoring is performed;

an actual torque determining arrangement to determine, during the functional monitoring, an actual torque based on performance quantities of the internal combustion engine; and a monitoring arrangement to monitor for a deviation from a permissible torque, wherein the individual properties of the injection device are considered when determining the actual torque.

8. The control unit of claim 7, wherein compensating values corresponding to the individual properties of the injection device are used when determining the actual torque.

9. A computer readable medium having a computer program which is executable by a processor arrangement, the computer program being for a control unit of an internal combustion engine, the computer readable medium comprising:

program code for operating an internal combustion engine, including:

injecting fuel using an injection device into a combustion chamber of a cylinder of the internal combustion engine;

determining a fuel quantity, which is to be injected, as a function of individual properties of the injection device, in which functional monitoring is performed;

determining, during the functional monitoring, an actual torque based on performance quantities of the internal combustion engine; and monitoring for a deviation from a permissible torque, wherein the individual properties of the injection device are considered when determining the actual torque.

10. The computer program of claim 9, wherein the computer readable medium includes a computer-readable data carrier.

* * * * *